US005078858A

United States Patent [19]

Hart et al.

[11] Patent Number: 5,078,858

[45] Date of Patent: Jan. 7, 1992

[54] METHODS OF EXTRACTING IRON SPECIES FROM LIQUID HYDROCARBONS

[75] Inventors: Rosalie B. Hart, The Woodlands; Paul V. Roling, Spring, both of Tex.

[73] Assignee: Betz Laboratories, Inc., Trevose, Pa.

[21] Appl. No.: 561,049

[22] Filed: Aug. 1, 1990

[51] Int. Cl.[5] ..... C10G 17/00

[52] U.S. Cl. ..... 208/252; 585/833; 585/864

[58] Field of Search ..... 208/252; 585/864

[56] References Cited

U.S. PATENT DOCUMENTS

| | | | |
|---|---|---|---|
| 2,739,103 | 3/1956 | Thompson | 208/252 |
| 2,744,853 | 5/1956 | Kavanagh et al. | 208/252 |
| 2,767,123 | 10/1956 | Hickok et al. | 208/252 |
| 4,778,590 | 10/1988 | Reynolds | 208/252 |
| 4,778,591 | 10/1988 | Reynolds | 208/252 |
| 4,789,463 | 12/1988 | Reynolds | 208/252 |
| 4,818,373 | 4/1989 | Bartholic et al. | 208/252 |
| 4,853,109 | 8/1989 | Reynolds | 208/252 |

*Primary Examiner*—Helane E. Myers
*Attorney, Agent, or Firm*—A. D. Ricci; Bruce E. Peacock

[57] ABSTRACT

Methods of extracting iron species, such as iron naphthenate, and iron sulfides, from a liquid hydrocarbon, such as crude oil are disclosed. A chelant selected from oxalic or citric acid is added directly to the liquid hydrocarbon and mixed therewith. Then, wash water is added to form a water in oil emulsion. The emulsion is resolved, with iron laden aqueous phase being separated.

20 Claims, No Drawings

METHODS OF EXTRACTING IRON SPECIES FROM LIQUID HYDROCARBONS

FIELD OF THE INVENTION

The present invention pertains to the use of oxalic or citric acid to remove undesirable iron contaminants from liquid hydrocarbons, such as crude oil.

BACKGROUND OF THE INVENTION

Liquid hydrocarbon mediums, such as crude oils, crude fractions, such as naphtha, gasoline, kerosene, jet fuel, fuel oil, gas oil and vacuum residuals, often contain metal contaminants that, upon processing of the medium, can catalyze undesirable decomposition of the medium or accumulate in the process residue. Accumulation of iron contaminants, like others, is undesirable in the product remaining after refinery, purification, or other processes and, accordingly, diminishes the value of such products.

Similar iron contamination problems are experienced in conjunction with other liquid hydrocarbons, including aromatic hydrocarbons (i.e., benzene, toluene, xylene), chlorinated hydrocarbons (such as ethylene dichloride), and olefinic and naphthenic process streams. All of the above petroleum feedstock and fractions and petrochemicals are referred to herein as "liquid hydrocarbonaceous mediums".

Iron in such liquid hydrocarbonaceous mediums may occur in a variety of forms. For example, it may be present as a naphthenate, porphyrin, or sulfide. In any case, it is troublesome. For example, residuals from iron-containing crudes are used, inter alia, to form graphite electodes for industry. The value and useful life of these elecrodes is diminished proportionately with the level of undesirable iron contamination.

Additionally, in many processes iron-containing catalysts are used which may carry over the product during purification. Iron catalyst contaminated product leads to deleterious effects.

PRIOR ART

It is well known that inorganic acids, at low pHs, will extract organic phase dissolved species into the water phase.

In Reynolds U.S. Pat No. 4,853,109, it is taught that dibasic carboxylic acids, including oxalic acid, are added to a hydrocarbonaceous feedstock in the form of an aqueous solution comprising the oxalic acid. In this disclosure, the oxalic acid is dissolved in water and then added to the crude. Separation of the w/o emulsion so formed is usually achieved in a desalter although countercurrent extraction techniques are also mentioned.

Other prior art patents that may be of interest include: U.S. Pat. No. 4,276,185 (Martin) disclosing methods of removing iron sulfide deposits from surfaces by using, inter alia, oxalic or citric acid; and U.S. Pat. No. 4,548,700 (Bearden et al) disclosing a slurry hydroconversion process in which a hydrocarbon charge is converted to a hydroconverted oil product. In Bearden et al, a heavy oil portion of the products is separated and partially gassified to produce a carbon-free metal-containing ash that is extracted with oxalic acid. The resulting metal containing oxalic acid extract is recycled to the hydroconversion zone as catalyst precursor.

U.S. Pat. No. 4,342,657 (Blair, Jr.) and 4,830.766 (Gallup et al) can be noted as being of general background interest.

SUMMARY OF THE INVENTION

The present invention provides enhanced iron removal by the use of oxalic acid or by citric acid. In contrast to the Reynolds patent, the chelant is added directly to the liquid hydrocarbon instead of being added to the hydrocarbon in the form of an aqueous solution. Additionally, in the present invention, the chelant is preferably dissolved in an organic solvent. In accordance with the invention, effective iron removal is achieved at water phase pHs of from 6–11.

DETAILED DESCRIPTION OF THE INVENTION

We have found that introduction of oxalic or citric acid directly into the liquid hydrocarbon, in an amount of from 1–10 moles based upon each mole of iron present in the liquid hydrocarbon, significantly increases the iron removal efficacy, when compared to introduction from the aqueous phase.

The citric acid or oxalic acid chelant may be fed neat into the hydrocarbon or, dissolved or dispersed in an organic solvent, such as heavy aromatic naphtha, glyme, diglyme, triglyme, methyl alcohol, benzene, xylene, hexane, etc., for direct introduction into the liquid hydrocarbonaceous medium. Preferably, the chelant is dissolved in a polar organic solvent, such as glyme, diglyme, triglyme, or methylalcohol.

After the chelant is added to and mixed with the liquid hydrocarbon, water is added to the resulting mixture of hydrocarbon-chelant in an amount of about 1–15% water based on the weight of the liquid hydrocarbon. Preferably, water is added in an amount of about 5–10 wt.%. The w/o emulsion thus formed is resolved with iron laden aqueous phase being separated. Reduced iron content hydrocarbon phase may be then subjected to further processing prior to end-use or it may be directly used for its intended end purpose as a fuel, etc.

Preferably, the emulsion is resolved in a conventional desalter apparatus. In typical desalters, optional pH operating conditions are maintained at from about 6–10 in order to retard corrosion and enhance emulsion resolution. Conventional desalters also utilize heat treatment and electric fields to aid in emulsion resolution. The methods of the present invention provide improvement in iron removal at such operating pHs and under the treatment conditions normally encountered in desalters.

The present invention has demonstrated effective removal of both iron naphthenate and iron sulfide species from xylene and crude samples and is therefore expected to function well with a host of liquid hydrocarbons and iron contaminants.

At present, a solution preferred for use comprises about 25% oxalic acid dissolved in triglyme.

Although the invention has been generally described for use in conjunction with petroleum crudes, other environments are contemplated. In fact, the present invention is thought applicable to extraction of iron from any iron containing liquid hydrocarbon. For example, in the manufacture of ethylene dichloride (EDC) hydrocarbon ethylene is chlorinated with the use of an iron containing catalyst. Carryover of the iron containing catalyst with the desired product during product purification diminishes the value and performance of the ethylene dichloride. Extraction of the liquid ethylene dichloride with oxalic or citric acid in accordance with the invention will reduce such contamination.

EXAMPLES

In order to assess the efficacy of the invention in extracting organic soluble iron species, the following examples were undertaken.

PROCEDURE

Unless otherwise noted, 95 ml (0.095 mmol or 0.000095 mol or $95\times10^{-6}$ or 56 ppm of Fe) of iron naphthenate in xylene (or crude oil), 5 ml of water, and the required amount of candidate extractant were added to each test flask and used for test purposes. The candidate extractant was added to either the water phase or the organic phase as noted. When added to the organic phase, the mixture of xylene and treatment was heated to 180° F. and maintained at that temperature for 20 minutes. Then, water was added and the resulting mixture was stirred for 20 more minutes. Stirring was stopped, the layers were allowed to separate, and the water layer was withdrawn from the bottom openeing stopcock of each flask. The withdrawn water phase was then analyzed for iron content via either a "wet procedure" or by ion coupled plasma analyses. A 2M HCl solution was used to perform two additional extractions on the remaining organic phase to remove the remaining iron so that a total iron balance could be calculated.

Percentage of Fe removal was calculated for each of the test runs. This figure represents the percent of iron extracted by one dosage of the candidate extractant. Fe balance is the total combined mols of iron extracted by the extractant and by the two HCl extractions. Acceptable limits on the Fe balances were set and are noted in the Tables below. An asterisk is listed to designate an experiment falling outside of an acceptable iron balance range.

As above noted, in certain instances a "wet method" was used for iron analyses. In accordance with this analytical method, an aliquot of the separated water phase from the flask (0.50 ml) was treated with 0.040 ml of 3% hydrogen peroxide, 3.0 ml of a saturated aqueous ammonium thiocyanate solution, and 4.0 ml of concentrated hydrochloric acid. It was then diluted to 100 ml with deionized water. The percent transmittance of this solution at 460 nm in 2.5 cm cells was determined. Micromoles of Fe for each was then calculcated in accordance with the equation $$\mu \text{ mol Fe} = \frac{\text{ml } H_2O \text{ in the extraction} \times \text{absorbence} \times 5.94}{\text{ml } H_2O \text{ water tested for Fe analysis}}$$

5.94 is a calibration standard derived from measurement of a known amount of iron.

Results appear in the following Tables.

TABLE I

Extraction of Iron Naphthenate from Xylene (95 mL, 0.0010M) into Water (5 mL) by OXALIC ACID

| Solvent | Oxalic Acid Concn (%) | Oxalic Acid Extractant mg used[c] | Extractant Added to | Water pH | Extracted % Fe | Balance[d] |
|---|---|---|---|---|---|---|
| None | 0 | 0 | water | 2.2 | 27 | 95 |
| None | 0 | 0 | water | 4.1 | 1 | 111* |
| None | 0 | 0 | water | 6.0 | 1 | 108* |
| None | 0 | 0 | water | 8.5 | 12 | 85 |
| None | 0 | 0 | water | 11.2 | 20 | 85 |
| None | 100 | 50 | water | 1.8 | 72 | 112* |
| None | 100 | 25 | water | 2.5 | 72 | 104 |
| None | 100 | 25 | water | 4.9 | 52 | 94 |
| None | 100 | 25 | water | 8.3 | 20 | 110 |
| Triglyme | 25 | 25 | water | 8.5 | 14 | 110 |
| Triglyme | 25 | 31.3 | xylene | 8.5 | 83 | 97 |
| Triglyme | 25 | 25 | xylene | 8.5 | 78 | 94 |
| Triglyme | 25 | 25 | xylene | 2.0 | 55 | 103 |
| Triglyme | 25 | 25 | xylene | 4.9 | 64 | 107 |
| Triglyme | 25 | 25 | xylene | 6.0 | 65 | 95 |
| Triglyme | 25 | 25 | xylene | 11.0 | 82 | 104 |
| Triglyme | 25 | 12.5 | xylene | 2.0 | 51 | 113* |
| Triglyme | 25 | 12.5 | xylene | 4.9 | 65 | 90 |
| Triglyme | 25 | 12.5 | xylene | 8.0 | 55 | 102 |
| Triglyme | 25 | 12.5 | xylene | 10.0 | 64 | 99 |
| Triglyme | 25 | 6.3 | xylene | 8.5 | 33 | 102 |
| Triglyme | 25 | 25 | xylene | 8.5 | 38 | 106 |
| Triglyme | 25 | 25 | xylene | 10 | 61 | 113(a)* |
| Triglyme | 25 | 25 | xylene | 8.5 | 8 | 90(b) |
| None | 0 | 0 | water | 2.2 | 31 | 123* |
| None | 100 | 50 | water | 3.9 | 50 | 123* |
| None | 100 | 50 | water | 6.3 | 21 | 123* |
| None | 100 | 50 | water | 7.7 | 9 | 124* |

*Out of Fe Balance Runs

[a]Used a solution containing about 50 mg of Na4EDTA in water (pH ~ 10) where the iron oxalate that formed was solubilized by the EDTA.

[b]Extracted a solution of 0.001M FeN and 0.001M CaN. (N = naphthenate).

[c]At 12.5 mg of oxalic acid, the oxalic acid was in equimolar proportion to the amount of iron in the test solutions. Ppm levels of oxalic acid are ten times the mg used. Thus 12.5 mg = 125 ppm.

[d]Iron balances were acceptable within the range of 95 ± 15 ppm.

TABLE II

Iron extraction with 5 ml water and 95 ml 0.001M iron naphthenate in xylene -treatment added to the xylene phase- (pH of water phase 8.5)

| Treatment | mg Extractant Used | Additional Compound | % Fe Extracted | Fe Balance |
|---|---|---|---|---|
| oxalic acid | 25 | commercial | 49 | 97 |

TABLE II-continued

Iron extraction with 5 ml water and 95 ml 0.001M iron naphthenate in xylene -treatment added to the xylene phase- (pH of water phase 8.5)

| Treatment | mg Extractant Used | Additional Compound | % Fe Extracted | Fe Balance |
|---|---|---|---|---|
| 25% dissolved in triglyme | | metal deactivator | | |
| citric acid 25% dissolved in MeOH | 25 | — | 34 | 96 |

Fe balance acceptable at 95±15 ppm.

TABLE III

Iron extraction of 95 ml 0.001M Ferrocene in Xylene with 5 ml water. Treatment added to xylene phase (pH water phase = 8.5).

| Treatment | mg extractant used | % Fe extracted | Fe Balance |
|---|---|---|---|
| oxalic acid 25% dissolved in triglyme | 25 | 8 | 134*• |
| citric acid 25% dissolved in MeOH | 25 | 17 | 127*• |

•data thought unreliable; outside of iron balance range of 95 ± 15.

TABLE IV

Iron extraction with 5 ml DI (de-ionized) water and 95 ml 0.001M FeS in Xylene with treatment added to the Xylene Phase.

| Treatment | mg extractant used | % Fe extracted | Fe Balance |
|---|---|---|---|
| oxalic acid 25% dissolved in triglyme | 25 | 30 | 82 |

TABLE V

Extraction of Raw Crude, Louisiana Refinery

| Treatment | mg of extract-ant used | pH water | % Fe Extracted | Fe Balance |
|---|---|---|---|---|
| None | 0 | 8.5 EDTA | 28 | 21 |
| oxalic 25% solution dissolved in triglyme | 12.5 | 8.5 | 10 | 15 |
| oxalic 25% solution dissolved in triglyme | 50 | 8.5 | 32 | 21 |
| oxalic 25% solution dissolved in triglyme | 50 | D.I. | 31 | 15 |
| citric acid 40% solution in MeOH | 200 | 8.5 | 64 | 7* |

Iron balance in crude should be within the range of 18±4. EDTA, where noted, indicates that about 50 mg of $Na_4$ EDTA was added to the water layer to help solubilize the iron oxalate.

Treatments were added to the oil phase.

TABLE VI

Extraction of Western Raw Crude (treatment added to the oil)

| Treatment | mg of extractant used | pH water | % Fe Extracted | Fe Balance |
|---|---|---|---|---|
| HCl (2M) | — | — | — | 22 |
| oxalic acid 25% solution in triglyme | 25 | DI | 7 | 32* |
| oxalic acid 25% solution in triglyme | 62.5 | 8.5 | 10 | 10* |
| oxalic acid 25% solution in triglyme | 100 | 8.5[1] | 9 | 11 |
| citric acid 40% solution in MeOH | 100 | 8.5 | 34 | 16 |
| citric acid 40% solution in MeOH | 200 | 8.5 | 47 | 22 |
| citric acid 40% solution in MeOH | 300 | 8.5 | 36 | 10* |
| citric acid plus oxalic acid | 100 (citric) 62.5 (oxalic) | 8.5 | 43 | 19 |

Acceptable Fe balance = 17 ± 6

[1]about 50 mg of $Na_4$ EDTA added to the water layer to solubilize the iron salts.

TABLE VII

Extraction of Western Raw Crude treatment added to oil (ppm of metals in crude after extraction)

| Treatment | mg of extractant used | Fe ppm |
|---|---|---|
| none | — | 13 |
| citric acid | 62.5 | 9 |
| oxalic acid | 62.5 | 18 |

Amount of Fe in water extracts was only a trace. No Fe balance was measured. Fe determined by ICP.

TABLE IX

Eastern Raw Crude Treatment Added to Crude

| Treatment | mg of extractant used | pH water | % Fe Extracted | Fe Balance |
|---|---|---|---|---|
| citric acid 40% | 100 | 8.5 | 29 | 29 |
| citric acid 40% | 100 | 8.5 | 28 | 29 |
| citric acid 40% | 200 | 8.5 | 63 | 30 |
| citric acid 40% | 200 | 8.5 | 66 | 37 |
| citric acid plus oxalic acid | 100 (citric) 62.5 (oxalic) | 8.5 | 66 | 33 |

Fe balance 38±11

SIMULATED DESALTER TESTS (COMPARATIVE TESTS)

Procedure

In order to contrast the present invention wherein oxalic acid or citric acid chelant is added directly to the oil phase with conventional chelant introduction into the water in oil emulsion, simulated desalter tests were undertaken where the chelant was added to the water in oil emulsion. Here, 15 ml of wash water (pH≈6) were added to each test tube cell along with 85 ml of crude and 24 ppm of a commercial emulsion breaker (Pro-Chem 2W6—Betz Process Chemicals, Inc., The Woodlands, Tex.). 340 μL of a 25% concentration of each candidate chelant were added to each test cell. The mixtures were then separated by use of a simulated desalting apparatus which comprises an oil bath reservoir with most of each test cell tube submerged therein. The temperature of the oil bath can be varied to about 300° F. to simulate actual field conditions. Electrodes were operatively connected to each test cell to impart an electric field of variable potential through the test emulsions contained in the test cell tubes to aid in resolving the emulsion. Under simulated desalting conditions, the mixtures in the test cell tubes were allowed to separate for a period of 1 day with aliquots from the crude, water and middle emulsion layers taken for purposes of metal content measurement. Since the metals were concentrated by a factor of almost six when extracted into the water phase, the ppm levels in water that are given below are corrected for this effect to give a comparable ppm versus the oil. Metals content was measured by ICP procedures after ashing to remove the oil.

Results are given in Table X.

TABLE X

| | (Comparative Examples) (Chelant Added to Emulsion) | | | |
|---|---|---|---|---|
| Treatment | Ca | Fe | Ni | V |
| PPM levels in oil Phase After Extraction | | | | |
| — | 92 | 40 | 56 | 72 |
| oxalic acid | 86 | 41 | 53 | 71 |
| citric acid | 34 | 31 | 47 | 58 |
| PPM levels in Middle Emulsion Layer After Extraction | | | | |
| — | 82 | 34 | 43 | 53 |
| oxalic acid | 97 | 35 | 44 | 55 |
| citric acid | 49 | 39 | 53 | 61 |
| PPM Levels in Water Phase After Extraction (divided by 6 to give relative ppm versus oil phase) | | | | |
| — | 12 | 1 | 0 | 0 |
| oxalic acid | 6 | 0 | 0 | 0 |
| citric acid | 49 | 4 | 0 | 0 |

DISCUSSION

The above examples demonstrate that oxalic acid and citric acid serve as effective iron extractants when added to the organic phase with pHs of the subsequently added water phase being about 6–11. As can be seen in Table I, even without oxalic acid addition, some extraction of iron (from an iron naphthenate solution) occurred at low and at high pHs. Addition of oxalic acid to the water layer (as per U.S. Pat. No. 4,853,109) results in good amounts of iron extraction at low pHs, but iron extraction at pH of around 8 was no better with or without oxalic acid added to the water layer. Surprisingly, and in accordance with the invention, dissolving the oxalic acid in an organic solvent and adding this solution to the organic layer resulted in remarkable improvement in iron extractions at higher (i.e., pH 6–11) pHs. In contrast, addition of the organic solution of the oxalic acid to the water layer at pH 8 did not improve iron extraction.

While this invention has been described with respect to particular embodiments thereof, it is apparent that numerous other forms and modifications will be obvious to those skilled in the art. The appended claims generally should be construed to cover all such obvious forms and modifications which are within the true spirit and scope of the present invention.

What is claimed is:

1. Method of extracting iron species from a liquid hydrocarbonaceous medium comprising contacting said medium with a non-aqueous form of a chelant selected from the group consisting of oxalic acid and citric acid to form a chelant containing reaction mixture, then adding water having a pH of about 6–11 to said reaction mixture to form an emulsion, separating said emulsion and removing iron-laden water from said separated emulsion.

2. Method as recited in claim 1 wherein said contacting comprises adding from about 1–10 moles of said chelant to said medium per mole of iron in said medium.

3. Method as recited in claim 1 wherein said liquid hydrocarbon comprises a crude oil.

4. Method as recited in claim 1 wherein said liquid hydrocarbon comprises an aromatic hydrocarbon selected from xylene, benzene, or toluene.

5. Method as recited in claim 1 wherein said liquid hydrocarbon comprises naphtha, gasoline, kerosene, jet fuel, fuel oil, gas oil, or vacuum residual.

6. Method as recited in claim 1 wherein said liquid hydrocarbonaceous medium comprises an olefinic, naphthenic, or chlorinated hydrocarbon material.

7. Method as recited in claim 1 wherein said separating occurs in a desalter.

8. Method as recited in claim 1 wherein said iron species comprises a member selected from the group consisting of iron naphthenate and iron sulfide.

9. Method as recited in claim 1 wherein said chelant is dissolved or dispersed in an organic solvent.

10. Method as recited in claim 9 wherein said organic solvent comprises glyme, diglyme, triglyme or methyl alcohol.

11. Method as recited in claim 1 wherein said chelant comprises oxalic acid.

12. Method as recited in claim 1 wherein said chelant comprises citric acid.

13. A method of removing iron species from crude oil comprising first contacting said crude with a non-aqueous form of chelant selected from oxalic acid and citric acid, said chelant being present in an amount of about 1–10 moles thereof based upon the number of moles or iron in said crude oil, subsequently adding 1–15% water having a pH of about 6–11 to said reaction mixture to form an emulsion, resolving said emulsion, and separating iron laden water phase from said emulsion.

14. A method as recited in claim 13 wherein said chelant comprises oxalic acid.

15. A method as recited in claim 13 wherein said chelant comprises citric acid.

16. A method as recited in claim 13 wherein said iron species comprise iron naphthenate, iron sulfide or ferrocene.

17. A method as recited in claim 13 comprising resolving said emulsion in a desalter.

18. A method as recited in claim 13 wherein said chelant is dissolved or dispersed in an organic solvent.

19. A method as recited in claim 1 wherein said chelant is in neat solution form.

20. A method as recited in claim 13 wherein said chelant is in neat solution form.

* * * * *